US009627190B2

(12) United States Patent
Zaks et al.

(10) Patent No.: US 9,627,190 B2
(45) Date of Patent: Apr. 18, 2017

(54) ENERGY RESOLVED TIME-OF-FLIGHT MASS SPECTROMETRY

(71) Applicant: Agilent Technologies, Inc., Santa Clara, CA (US)

(72) Inventors: Julia Zaks, Santa Clara, CA (US); Trygve Ristroph, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/671,521

(22) Filed: Mar. 27, 2015

(65) Prior Publication Data

US 2016/0284531 A1 Sep. 29, 2016

(51) Int. Cl.

*H01J 49/40* (2006.01)
*H01J 49/06* (2006.01)
*H01J 49/00* (2006.01)

(52) U.S. Cl.

CPC ..... *H01J 49/401* (2013.01); *H01J 49/0027* (2013.01); *H01J 49/06* (2013.01)

(58) Field of Classification Search

CPC ..... H01J 49/40; H01J 49/025; H01J 49/405; H01J 49/009; H01J 49/406; H01J 49/004; H01J 49/0068; H01J 49/164; H01J 49/061; H01J 49/0031; H01J 49/0495; H01J 49/401; H01J 49/0004; H01J 49/0027; H01J 49/02; H01J 49/06; H01J 49/107; H01J 49/26; H01J 49/28; H01J 49/34; H01J 49/403; H01J 49/443; H01J 49/48; H01J 37/05; H01J 37/244; H01J 37/285; H01J 37/3174

USPC ... 250/287, 282, 281, 288, 286, 396 R, 397, 250/283, 290, 294, 300, 305, 307, 250/396 ML, 398, 423 P

See application file for complete search history.

(56) References Cited

U.S. PATENT DOCUMENTS 4,472,631 A * 9/1984 Enke ..... B01D 59/44 250/281
5,160,840 A * 11/1992 Vestal ..... H01J 49/405 250/282
5,464,985 A * 11/1995 Cornish ..... H01J 49/405 250/287
5,594,243 A * 1/1997 Weinberger ..... H01J 49/025 250/281

(Continued)

FOREIGN PATENT DOCUMENTS

JP 2003068245 3/2003
WO 8304187 12/1983

(Continued)

OTHER PUBLICATIONS

W.C. Wiley and I. H. McLaren, "Time-of-Flight Mass Spectrometer with Improved Resolution", Mass Spectrommeter, The Review of Scientific Instruments, vol. 26, No. 12 , pp. 1150-1157 (Dec. 1955).

(Continued)

*Primary Examiner* — David A Vanore

(57) ABSTRACT

A time-of-flight mass spectrometer (TOF-MS) utilizes an ion dispersion device and a position-sensitive ion detector or an energy-sensitive ion detector to enable measurement of time of flight and kinetic energy of ions arriving at the detector. The measurements may be utilized to improve accuracy in calculating ion masses.

21 Claims, 8 Drawing Sheets

(56) References Cited

U.S. PATENT DOCUMENTS 5,869,829 A * 2/1999 Dresch ..... H01J 49/40 250/282
5,994,694 A * 11/1999 Frank ..... H01J 49/025 250/281
6,008,491 A * 12/1999 Smentkowski ..... H01J 49/405 250/287
6,013,913 A * 1/2000 Hanson ..... H01J 49/406 250/282
6,040,575 A * 3/2000 Whitehouse ..... B82Y 15/00 250/282
6,107,625 A * 8/2000 Park ..... H01J 49/406 250/282
6,294,790 B1 * 9/2001 Weinberger ..... H01J 49/025 250/397
6,518,568 B1 * 2/2003 Kovtoun ..... H01J 49/40 250/287
6,518,569 B1 * 2/2003 Zhang ..... H01J 49/405 250/287
6,521,887 B1 2/2003 Funsten et al.
6,683,299 B2 * 1/2004 Fuhrer ..... H01J 49/004 250/282
6,683,301 B2 * 1/2004 Whitehouse ..... B82Y 30/00 250/287
6,703,608 B2 * 3/2004 Holle ..... H01J 49/40 250/282
6,781,121 B1 * 8/2004 Davis ..... H01J 49/025 250/281
7,019,286 B2 * 3/2006 Fuhrer ..... G01N 27/622 250/282
7,429,729 B2 * 9/2008 Schultz ..... G01N 27/622 250/286
7,439,520 B2 * 10/2008 Vestal ..... H01J 49/06 250/305
7,663,100 B2 * 2/2010 Vestal ..... H01J 49/164 250/281
7,667,195 B2 * 2/2010 Vestal ..... H01J 49/40 250/281
7,838,824 B2 * 11/2010 Vestal ..... H01J 49/004 250/282
7,928,361 B1 * 4/2011 Whitehouse ..... H01J 49/401 250/281
8,502,139 B2 * 8/2013 Yavor ..... H01J 49/405 250/281
8,575,544 B1 * 11/2013 Kelly ..... H01J 37/244 250/281
8,604,423 B2 * 12/2013 Enke ..... H01J 49/0031 250/281
8,642,951 B2 * 2/2014 Li ..... H01J 3/16 250/287
8,975,579 B2 * 3/2015 Bream ..... H01J 49/443 250/286
2001/0054684 A1 * 12/2001 Park ..... H01J 49/0068 250/287
2003/0136903 A1 * 7/2003 Weiss ..... H01J 49/401 250/287
2006/0289746 A1 * 12/2006 Raznikov ..... G01N 27/622 250/294
2008/0087814 A1 * 4/2008 Loucks ..... H01J 49/107 250/287
2008/0149846 A1 * 6/2008 Platzgummer ..... B82Y 10/00 250/398
2008/0173807 A1 7/2008 Yoon et al.
2010/0193681 A1 * 8/2010 Vestal ..... H01J 3/14 250/287
2010/0252728 A1 10/2010 Mackie et al.
2012/0305760 A1 * 12/2012 Blick ..... H01J 43/246 250/282
2015/0014522 A1 * 1/2015 Haufler ..... H01J 49/406 250/282

FOREIGN PATENT DOCUMENTS

WO 9945569 9/1999
WO 2005043575 A2 5/2005
WO 2007106449 A2 9/2007

OTHER PUBLICATIONS

"Time-of-Flight Mass Analyzers" Chapter 8, Advances in Imaging and Electron Physics, vol. 157, pp. 283-316, (2009).
GB Search Report dated Aug. 8, 2016 from GB Application No. 1603864.8.

* cited by examiner

ENERGY RESOLVED TIME-OF-FLIGHT MASS SPECTROMETRY

TECHNICAL FIELD

The present invention relates generally to time-of-flight mass spectrometry (TOF-MS), and particularly to TOF-MS involving measurement of ion kinetic energy.

BACKGROUND

A mass spectrometry (MS) system in general includes an ion source for ionizing molecules of a sample of interest, followed by one or more ion processing devices providing various functions, followed by a mass analyzer for separating ions based on their differing mass-to-charge ratios (or m/z ratios, or more simply "masses"), followed by an ion detector at which the mass-sorted ions arrive. An MS analysis produces a mass spectrum, which is a series of peaks indicative of the relative abundances of detected ions as a function of their m/z ratios. Mass spectrometers are commonly used to determine the chemical composition of mixtures by precise measurement of the mass-to-charge ratio of the constituent molecular ions.

One particular type of mass spectrometer is a time-of-flight mass spectrometer (TOF-MS), which is utilized for molecular and elemental identification within a variety of disciplines ranging from medicine, biological research, environmental monitoring, chemical manufacturing, energy, and forensics. Time-of-flight mass spectrometry (TOF-MS) offers a powerful combination of mass resolution, accuracy, speed, and mass range which together make the technique well-suited for the analytical challenges presented by these fields. TOF-MS utilizes a high-resolution mass analyzer (TOF analyzer) in the form of a flight tube, which encloses a space that is electric field-free except for localized fields imparted by devices in the flight tube such as an ion mirror. An ion accelerator (or pulser) injects ions in pulses (or packets) into the flight tube. Ions of differing masses travel at different velocities through the flight tube and thus separate (spread out) according to their differing masses before arriving at the ion detector, enabling mass resolution based on time-of-flight. In a typical TOF-MS, ions travel along a drift direction through one or more gas-filled ion guides, and one or more beam-limiting apertures operating in a collision-free environment, and into the pulsed ion accelerator. In an orthogonal acceleration TOF-MS (oa-TOF-MS), the ion accelerator receives the ions along the drift direction and injects the ions along an acceleration direction orthogonal to the drift direction. The flight tube may include one or more ion mirrors (or "reflectrons") that increase the length of the ion flight path and provide certain advantages.

In TOF-MS, chemical composition is determined by accurately measuring the masses of individual ions drawn from the sample. The critical mass measurement stage is realized by measuring the time elapsed as ions travel from an ion accelerator through a known path length. Ions end their flight on a fast ion detector at which a single ion is transformed into a nanosecond-scale electronic signal, which is digitized with a high speed data acquisition system. The inherent simplicity and speed of this process translates into multiple analytical advantages for the end user. Because TOF-MS is able to gather a complete mass spectrum for each firing of the ion accelerator, it is particularly well-suited for tandem mass spectrometry (MS/MS) in which the fragmentation spectrum associated with a particular parent ion mass is measured.

TOF-MS is commonly used to determine the chemical composition of unknown mixtures. Mass resolution and sensitivity are two of the most fundamental and important instrument parameters when analyzing complex mixtures and identifying unknown compounds. High-resolution instruments are able to resolve two or more compounds which are closely-spaced in mass, a situation commonly found in complex mixtures in chemical and life sciences applications. Improvements to mass resolution typically also improve mass accuracy which in turn results in improved identification of unknown compounds. Since many of the compounds are present only at low concentrations, instruments which have both high sensitivity and high resolution are needed. Existing approaches to improving resolution and their disadvantages are described below. There remains an ongoing need for improving the resolution and/or sensitivity of time-of-flight mass spectrometers.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a time-of-flight mass spectrometry (TOF-MS) system includes: an ion source; a TOF analyzer comprising an ion accelerator, a flight tube, and an ion detector comprising a plurality of channels; and an ion dispersion device configured for dispersing ions from the ion source into a plurality of spatially separated ion beams based on different kinetic energies of the ions, wherein ions of different kinetic energies travel in the flight tube in spatially separated flight paths and respective channels are aligned with the flight paths.

According to another embodiment, time-of-flight mass spectrometry (TOF-MS) system includes: an ion source; and a TOF analyzer comprising an ion accelerator, a flight tube, and an energy-sensitive ion detector, wherein the energy-sensitive ion detector is configured for both detecting arrival times of ions and measuring kinetic energy of the ions.

According to another embodiment, a method for performing time-of-flight mass spectrometry (TOF-MS) includes: receiving an ion measurement signal from an ion detector of a TOF analyzer corresponding to detection of an ion; determining a time of flight and a kinetic energy of the ion based on the ion measurement signal; and calculating a mass of the ion by applying a mass calibration function based on the time of flight and the kinetic energy.

According to another embodiment, a time-of-flight mass spectrometry (TOF-MS) system configured for performing all or part of any of the methods disclosed herein.

According to another embodiment, a time-of-flight mass spectrometry (TOF-MS) system includes: an ion source; a TOF analyzer; an ion detector; and a computing device configured for performing all or part of any of the methods disclosed herein.

According to another embodiment, a system for acquiring spectral data from a sample includes: a processor and a memory configured for performing all or part of any of the methods disclosed herein.

According to another embodiment, the system includes a computing device and an ion detector, wherein the computing device comprises the processor and the memory, and the ion detector is configured for transmitting ion measurement signals to the computing device.

According to another embodiment, a computer-readable storage medium includes instructions for performing all or part of any of the methods disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
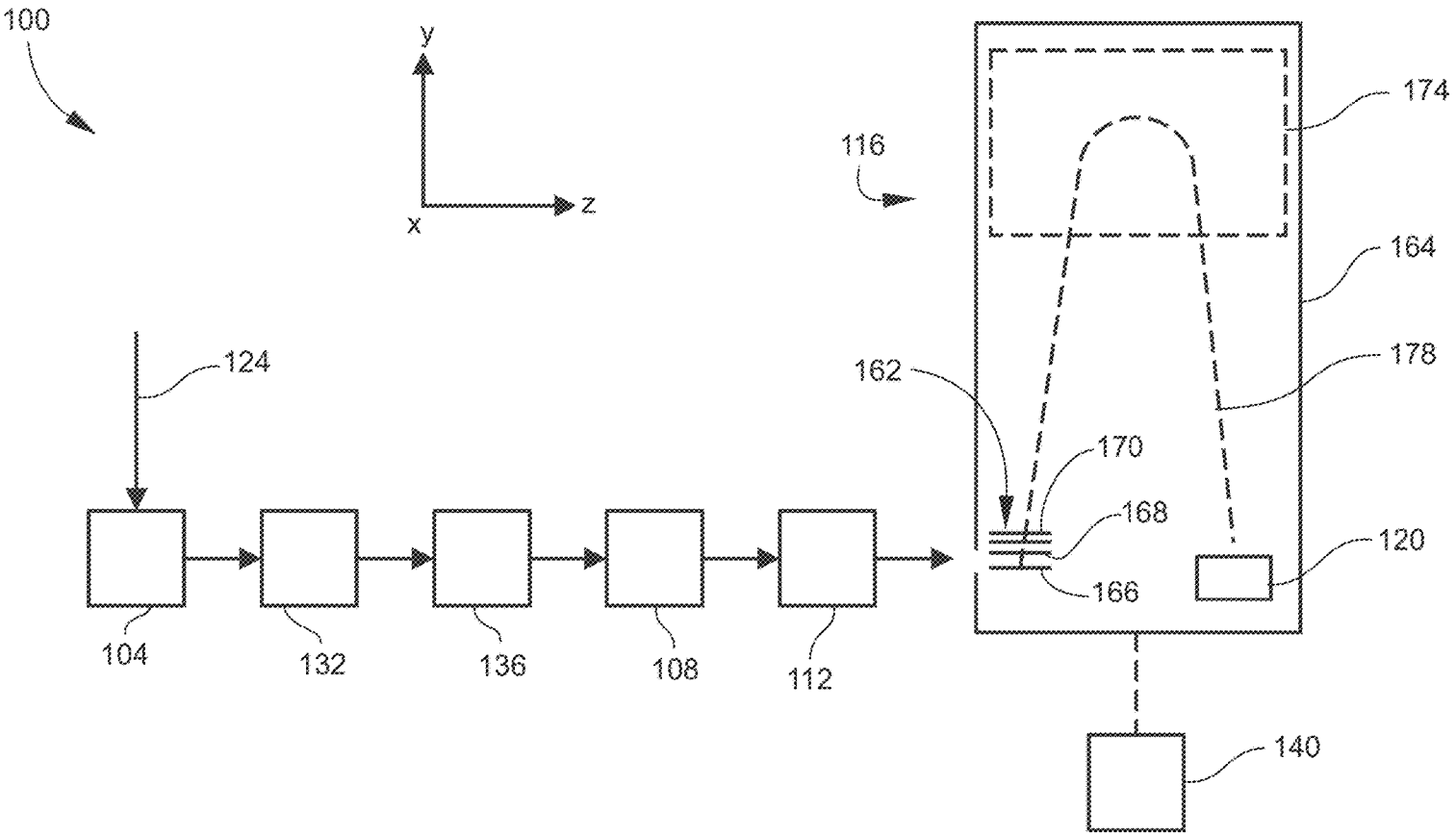
FIG. 1 is a schematic view of an example of a time-of-flight mass spectrometer (TOF-MS) or time-of-flight mass spectrometry (TOF-MS) system according to some embodiments, which may be utilized in the implementation of the subject matter described herein.

FIG. 1 is a schematic view of an example of a time-of-flight mass spectrometer (TOF-MS) or time-of-flight mass spectrometry (TOF-MS) system 100 according to some embodiments, which may be utilized in the implementation of the subject matter disclosed herein. The operation and design of various components of TOF-MS systems are generally known to persons skilled in the art and thus need not be described in detail herein. Instead, certain components are briefly described to facilitate an understanding of the subject matter presently disclosed.

For illustrative purposes, FIG. 1 (and other figures) includes a Cartesian coordinate frame of reference comprising a drift axis (z-axis), an acceleration axis (y-axis) orthogonal to the drift axis, and a transverse axis (x-axis) (into and out of the drawing sheet, in FIG. 1) orthogonal to the acceleration axis and to the drift axis. The acceleration axis and the transverse axis, which may both be referred to herein as "transverse" axes, lie in a transverse (x-y) plane orthogonal to the drift (z) axis. The coordinate frame is primarily intended to show the relative orientations of the three axes; the origin (0,0,0) of the coordinate frame relative to the TOF-MS system 100 has been arbitrarily located. In the present disclosure, the term "direction" may be used interchangeably with the term "axis." The primary direction of ion travel through the TOF-MS system 100 is along the drift axis, left to right from the perspective of FIG. 1.

The TOF-MS system 100 may generally include, in series of ion process flow along the drift axis, an ion source 104, one or more ion guides 108, ion optics 112, a time-of-flight (TOF) mass analyzer (TOF analyzer) 116, an ion detector 120, and a computing device (or system controller) 140. In general operation, sample molecules are introduced into the ion source 104, and the ion source 104 produces ions from sample molecules and transmits the ions to the ion guide(s) 108. The ion guide(s) 108 focus the ions as an ion beam and transmit the ions to the ion optics 112. The ion guide(s) 108 may perform additional ion processing functions such as compressing the ion beam, thermalizing (cooling) the ions, and other functions described below. The ion optics 112 transmit the ions to the TOF analyzer 116. The ion optics 112 may provide a collision-free environment and include beam-limiting apertures that shape the ion beam. The TOF analyzer 116 allows the ions to disperse based on differing flight times (due to their differing mass-to-charge (m/z) ratios) and travel to the ion detector 120. The ion detector 120 produces an ion signal that is then utilized to calculate actual times-of-flight from which m/z ratios are correlated, and construct a mass spectrum descriptive of the sample molecules as appreciated by persons skilled in the art.

The ion source 104 may be any type of continuous-beam or pulsed ion source suitable for producing analyte ions for spectrometry. Examples of ion sources 104 include, but are not limited to, electron ionization (EI) sources, chemical ionization (CI) sources, photo-ionization (PI) sources, electrospray ionization (ESI) sources, atmospheric pressure chemical ionization (APCI) sources, atmospheric pressure photo-ionization (APPI) sources, field ionization (FI) sources, plasma or corona discharge sources, laser desorption ionization (LDI) sources, and matrix-assisted laser desorption ionization (MALDI) sources. In some embodiments, the ion source 104 may include two or more ionization devices, which may be of the same type or different type. Depending on the type of ionization implemented, the ion source 104 may reside in a vacuum chamber or may operate at or near atmospheric pressure. Sample material to be analyzed may be introduced to the ion source 104 by any suitable means, including hyphenated techniques in which the sample material is an output 124 of an analytical separation instrument such as, for example, a gas chromatography (GC) or liquid chromatography (LC) instrument (not shown).

One or more ion guides 108 may include an arrangement of electrodes configured for confining ions along an axis while enabling the ions to be transmitted along the axis. For this purpose, depending on the type of ion guide radio frequency (RF) and/or direct current (DC) voltages may be applied to the ion guide electrodes. One or more of the ion guides 108 may have a converging geometry that compresses the ion beam so as to improve transmission into the next device. One or more of the ion guides 108 may be configured as a multipole structure with electrodes elongated generally along the direction of ion travel. One or more of the ion guides 108 may alternatively be configured as a straight cylindrical stacked-ring structure or an ion funnel, with ring-shaped electrodes or aperture-containing plate electrodes oriented orthogonal to the direction of ion travel. As a further alternative, one or more of the ion guides 108 may have a planar geometry as described below.

The ion optics 112 may occupy an evacuated volume of a desired axial length between the ion guide(s) 108 and the entrance to the TOF analyzer 116. The evacuated volume may be essentially collision-free, i.e., substantially devoid of neutral gas-phase molecules. The ion optics 112 may include one or more ion lenses arranged about an axis. An ion lens may be, as examples, a cylindrical electrode coaxial with the axis, a plate with an aperture on-axis, or pair of plates or half-cylinders separated by a gap on-axis. DC potentials may be applied to one or more of the ion lenses. One or more of the ion lenses may be configured as an ion slicer that ensures that the geometry of the ion beam matches the acceptance area of the entrance to the TOF analyzer 116, and that the ion energy distribution in at least one direction transverse to the direction of ion travel is a desired low value.

The TOF analyzer 116 includes an ion accelerator 162 leading into an evacuated, electric field-free TOF flight region 164 that may be enclosed by a tube (TOF flight tube) or other suitable enclosure. In the illustrated embodiment, the ion accelerator 162 is an orthogonal ion accelerator that receives ions along the drift (z) axis and accelerates ion packets into the flight region 164 along the acceleration (y) axis. For this purpose the electrodes of the ion accelerator 162 may include a repeller plate 166 (bottom electrode), acceleration grids 168 above the repeller plate 166, and a top grid or exit grid 170 above the acceleration grids 168. Ions enter the ion accelerator 162 in a loading region between the repeller plate 166 and the acceleration grids 168, and are accelerated into the flight region 164 through application of appropriate potentials to the repeller plate 166 and acceleration grids 168. In the orthogonal configuration, the flight region 164 is elongated along the acceleration (y) axis.

The illustrated embodiment further has a reflectron configuration in which the ion detector 120 is positioned generally at the same axial end (relative to the acceleration axis) of the flight region 164 as the ion accelerator 162, and spaced at a distance along the drift axis from the ion accelerator 162. An electrostatic ion mirror 174 (also known as a reflectron or Mamyrin mirror) is positioned at the opposite axial end (relative to the acceleration axis) of the flight region 164, whereby the ion mirror 174 is spaced from both the ion accelerator 162 and the ion detector 120 along the acceleration (y) axis.

The ion mirror 174 may be a single-stage, dual-stage, or gridless reflectron. The ion mirror 174 generates a potential gradient that decelerates ions down to zero velocity along the y direction and then accelerates the ions in the opposite direction, whereby ions exit the ion mirror 174 at the same kinetic energy they had when they entered the ion mirror 174. However, for ions of the same mass (m/z ratio), faster ions entering the ion mirror 174 sooner at higher kinetic energies penetrate deeper into the ion mirror 174 before stopping and turning around to exit, in comparison to slower ions of the same mass as the faster ions. These slower ions enter the ion mirror 174 later at lower kinetic energies and do not penetrate as far into the ion mirror 174 as the faster ions before stopping and turning around to exit. Hence, the slower ions do not spend as much time in the ion mirror 174 as the faster ions of the same mass, and thus are able to catch up with the faster ions such that all slower ions and faster ions of the same mass arrive at the ion detector 120 ideally at the same time. The ion mirror 174 thus creates a reflected focal point at the location of the ion detector 120, and reduces the variation in flight time spread due to the kinetic energy spread of ions of the same mass. The ion mirror 174 also increases the focal length of the TOF analyzer 116 and thus the overall flight times of the ions, which improves peak separation. FIG. 1 schematically depicts a representative ion flight path 178 through the flight region 164, including the turning point imposed by the ion mirror 174.

In operation, the ion accelerator 162 accelerates (injects) ions into the flight region 164 at a predetermined pulsing rate (or firing rate). Hence, the ion accelerator 162 injects discrete ion packets (or ion pulses) into the flight region 164. Each ion packet may include a range of ion masses. In each ion packet, ions of different masses travel through the flight region 164 at different velocities and thus have different overall times-of-flight, i.e., ions of smaller masses travel faster than ions of larger masses. Each ion packet spreads out (is dispersed) in space in accordance with the time-of-flight distribution. The ion detector 120 detects and records the time that each ion arrives at (impacts) the ion detector 120. A data acquisition process implemented by the computing device 140 correlates the recorded times-of-flight with m/z ratios.

In some embodiments, the ion accelerator 162 is operated at a multi-pulsing (or multiplexing) rate. In the multi-pulsing or multiplexing mode, the ion accelerator 162 fires at a rate fast enough that more than one ion packet occupies the flight region 164 at the same time. That is, before all ions of a previous ion packet have completed their flight paths in the flight region 164 and reached the ion detector 120, the next ion packet is injected into the flight region 164.

In some embodiments of the present disclosure, the ion detector 120 is a position-sensitive ion detector such as a multi-channel ion detector. As appreciated by persons skilled in the art, a multi-channel ion detector is configured for collecting and measuring the flux (or current) of mass-discriminated ions over a plurality of channels. Each channel, or pixel, corresponds to a discrete detection area or spot on the detector face, and is capable of detecting the impact of an ion at that detection spot and converting the detection event into an electrical signal independently from the other channels. Thus, a multi-channel ion detector is capable of making multiple measurements at multiple positions on the detector, and thereby generate multiple measurement signal outputs. Moreover, multiple channels can operate in this manner simultaneously provided they are spatially (optically) aligned with multiple ion flight paths. Each channel, for example, may be configured to operate as an individual electron multiplier, with each detection spot being a slot or tube. The size of the detection spots, and the spacing between adjacent detection spots, may be on the order of micrometers (e.g., less than 20 μm). The multiple channels may be arranged in a one-dimensional (linear) array along a desired direction (e.g., the drift axis or transverse axis), or in a two-dimensional (2D) array. One non-limiting example of a multi-channel detector is a micro-channel plate (MCP) detector.

In other embodiments the ion detector 120 is an energy-sensitive detector, examples of which are described below.

In some embodiments, the TOF-MS system 100 may be configured for implementing tandem MS (MS/MS). For example, the TOF-MS system 100 may be configured as a qTOF, or QqTOF instrument. Thus, the TOF-MS system 100 may include a first mass analyzer 132 upstream of the other mass analyzer 116 (the second, or final mass analyzer, in such embodiments), and an ion fragmentation device 136 between the first mass analyzer 132 and the second mass analyzer 116. The first mass analyzer 132 is configured for selecting ions of a specific m/z ratio (mass) or m/z ratio range and is typically, but not necessarily, configured as a quadrupole mass filter. The ion fragmentation device 136 is often a collision cell, which typically includes a non-mass-resolving, RF-only ion guide enclosed in a cell. The collision cell is pressurized by an inert gas to a level sufficient for producing fragment ions by collision-induced dissociation (CID) as appreciated by persons skilled in the art. However, a fragmentation device other than a CID-based device may be utilized such as, for example, a device configured for implementing electron capture dissociation (ECD), electron transfer dissociation (ETD), or infrared multiphoton dissociation (IRMPD). The second mass analyzer 116 resolves the fragment ions outputted by the ion fragmentation device 136 on the basis of m/z ratio (mass) and transmits the mass-resolved fragment ions to the ion detector 120, which outputs measurement signals from which fragment mass spectra are then produced.

The TOF-MS system 100 also includes a vacuum system for maintaining various interior regions of the TOF-MS system 100 at controlled, sub-atmospheric pressure levels. As appreciated by persons skilled in the art, the vacuum system may include vacuum lines communicating with the various interior regions via vacuum ports or exhaust ports, one or more vacuum-generating pumps, and associated components. The vacuum lines may also remove residual non-analytical neutral molecules from the ion path of the TOF-MS system 100.

The TOF-MS system 100 may also include a computing device (or system controller) 140. The computing device 140 is schematically depicted as representing one or more modules (or units, or components) configured for controlling, monitoring and/or timing various functional aspects of the TOF-MS system 100 described above. One or more modules of the computing device 140 may be, or be embodied in, for example, a desktop computer, laptop computer, portable computer, tablet computer, handheld computer, mobile computing device, personal digital assistant (PDA), smartphone, etc. The computing device 140 may also schematically represent all voltage sources not specifically shown, as well as timing controllers, clocks, frequency/waveform generators and the like as needed for applying voltages to various components of the TOF-MS system 100, including voltages applied to an ion dispersion device such as an ion deflector, sector instrument, or ion lenses as described below. The computing device 140 may also be configured for receiving the ion detection signals from the ion detector 120 and performing tasks relating to data acquisition and signal analysis as necessary to generate chromatograms, drift spectra, and mass (m/z ratio) spectra characterizing the sample under analysis. For example the computing device 140 may be configured for applying mass calibration methods and calculating ion mass, as described below. The computing device 140 may also be configured for providing and controlling a user interface that provides screen displays of spectrometric data and other data with which a user may interact. The computing device 140 may include one or more reading devices on or in which a tangible computer-readable (machine-readable) medium may be loaded that includes instructions for performing all or part of any of the methods disclosed herein. For all such purposes, the computing device 140 may be in signal communication with various components of the TOF-MS system 100 via wired or wireless communication links (as partially represented, for example, by a dashed line between the computing device 140 and the TOF analyzer 116). Also for these purposes, the computing device 140 may include one or more types of hardware, firmware and/or software, as well as one or more memories and databases.

Figure 2:
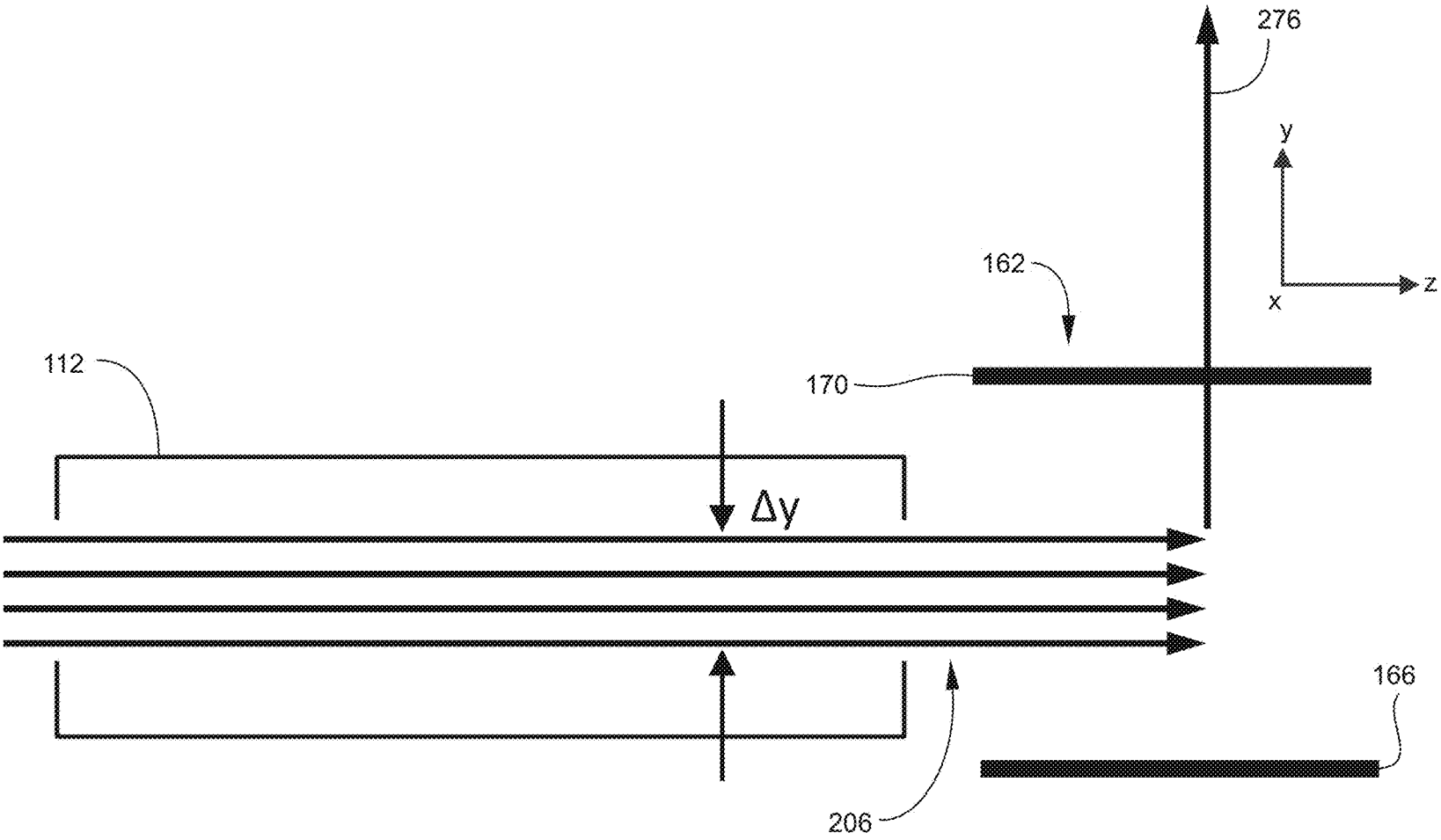
FIG. 2 is a schematic view of an ion accelerator configured for operation in an oa-TOF-MS according to some embodiments.

FIG. 2 is a schematic view of the ion accelerator 162 configured for operation in an oa-TOF-MS (such as the example described above and illustrated in FIG. 1). A primary ion beam 206 enters the ion accelerator 162 from the left along the drift direction, from an ion slicer or other upstream ion optics 112 and is accelerated by the ion accelerator 162 into the flight region along a flight path 276. The resolution of an oa-TOF MS is limited by several factors including aberrations, detector pulse width, data acquisition system bandwidth, voltage supply noise, and mechanical alignment. Two of the most important ion aberrations are turnaround time and the chromatic aberration. Turnaround time is due to the angular spread (i.e., divergence, not specifically shown) of the primary beam 206 in the drift-acceleration plane. The origin of the chromatic aberration is the non-zero spatial width ($\Delta y$) of the ion beam 206 entering the ion accelerator 162 which, upon acceleration, leads to a spread of kinetic energy ($\Delta K$). The spread in energy causes ions of the same mass-to-charge ratio to have a range of velocities in the flight path 276 and consequently a spread in TOF which degrades mass resolution.

Turnaround time and chromatic aberration are reduced by limiting the angular divergence and spatial width by using beam-limiting apertures, which may be part of the upstream ion optics 112. However, beam-limiting apertures reduce instrument sensitivity and are subject to ion beam contamination. Sensitivity and resolution can often be traded off by choice of aperture size and the focal properties of the associated optical system.

Increasing the length of the flight path in the TOF analyzer increases the overall flight time of the ions which generally increases mass resolution by reducing the effect of those pulse-width contributions which do not increase with length, such as detector pulse width and turnaround time. However, increasing the flight path increases the contribution due to energy spread and hence does not improve resolution infinitely. Increasing the length of the ion flight path in the analyzer also presents numerous challenges as the instrument increases in size and complexity. Additionally, longer flight path instruments generally have reduced sensitivity due to the so-called duty cycle which scales inversely with the distance between the pulsed accelerator and ion detector.

The effect of the energy spread can be compensated for by using an electrostatic mirror 174 (described above) to reduce the TOF variation with energy. Energy compensation makes a significant improvement in resolution and is generally well-worth the added cost and complexity. Two-stage gridded mirrors are commonly used in single-reflection mass analyzers. Despite the advantages, the energy compensation is imperfect, for example second-order for a dual-grid mirror. Introducing higher-order corrections in the mirror is possible, but increases complexity and causes additional ion loss in gridded mirrors.

Embodiments of the present disclosure provide a technique referred to herein as "Energy-Resolved TOF," or ER-TOF, as a modality for correcting or reducing the chromatic aberration. ER-TOF entails measuring both TOF and the ion kinetic energy K using an energy-sensitive or multi-channel ion detector. Measuring ion energy in addition to time-of-flight has the potential to eliminate the aberration due to energy spread which can be utilized to improve resolution, sensitivity, or both. A suitable mass calibration function that takes into account both the TOF and kinetic energy measured may then be applied to assign mass based on the measured TOF and kinetic energy. By this technique, it is possible to reduce the peak width of the instrument's single mass response.

Figure 3:
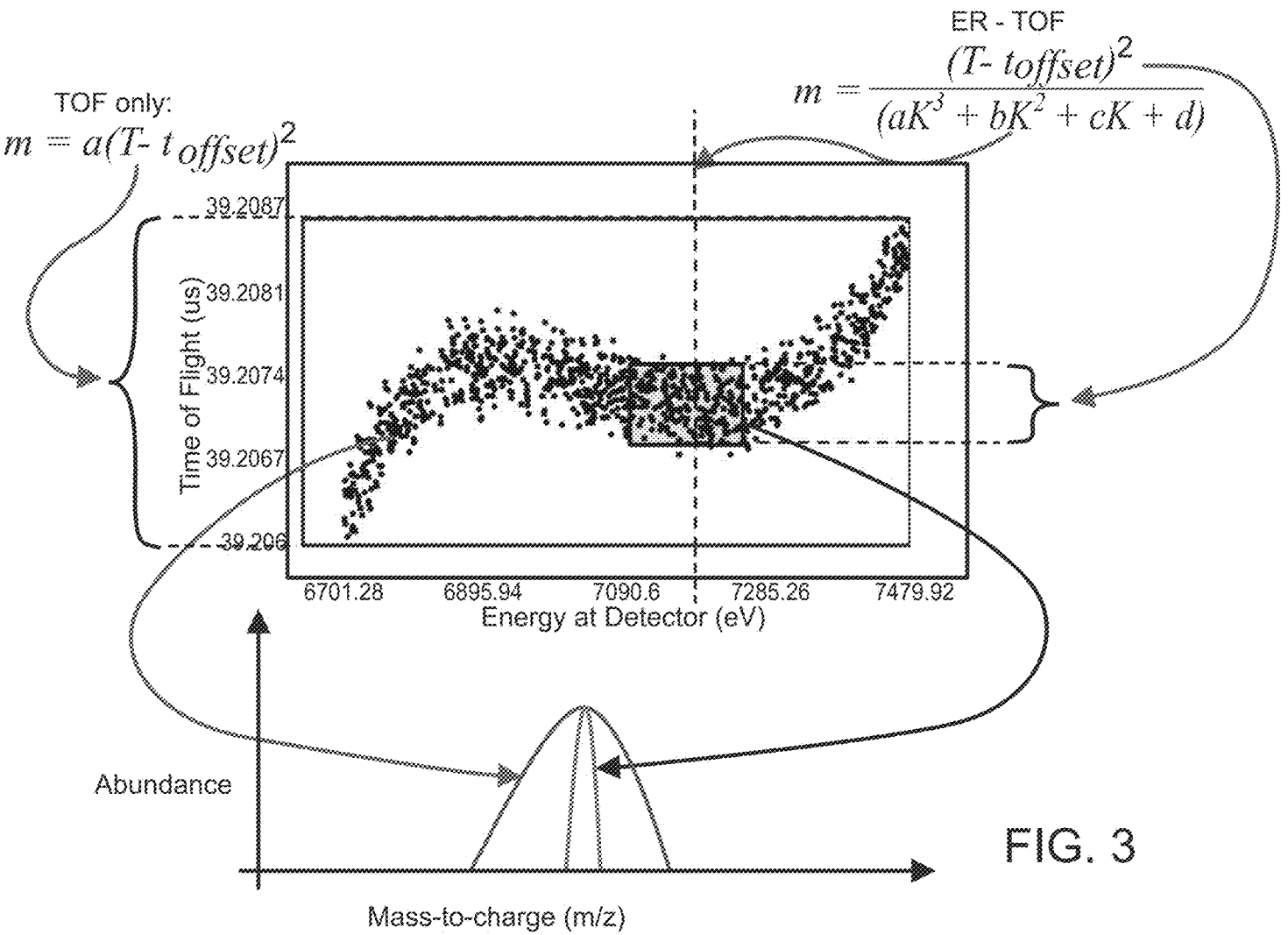
FIG. 3 is a plot of simulated values of ion energy (eV) and time-of-flight (μs) for an ion of m/z=500, and a peak diagram (abundance as a function of m/z ratio) demonstrating the reduction in peak width made possible by energy-sensitive mass calibration according to some embodiments.

FIG. 3 illustrates an example of the advantage of ER-TOF. FIG. 3 is a plot of simulated values of ion energy (eV) and time-of-flight (μs) for an ion of m/z=500. FIG. 3 illustrates the spread in energy and time-of-flight in a 1-meter long flight path for ions originating in the ion accelerator with both angle and position spread. In a two-stage gridded mirror, the time-of-flight is closely approximated by a cubic function of ion energy within the energy range of interest. Hence, in a single-reflecting flight path with a two-stage mirror, mass calibration may involve fitting a cubic function of energy. In this case, turnaround time causes the time-of-flight variation which is uncorrelated with energy. Generally, various mass calibration functions may be developed for this purpose. The particular mass calibration function selected in a given application may be one that is found to be optimal for a given instrument geometry and set of operating parameters. In the illustrated example, the mass calibration function is:

$$m = \frac{(T - t_{offset})^2}{(aK^3 + bK^2 + cK + d)},$$

where m is the corrected value of the calculated mass of the ion, T is the time-of-flight measured, K is the ion energy measured, and $t_{offset}$, a, b, c, and d are instrument-dependent calibration constants. This energy-sensitive mass calibration function may be compared to a conventional mass calibration function that accounts for time-of-flight only: $m=a(T-t_{offset})^2$. The reduction in peak width made possible by energy-sensitive mass calibration is shown in the peak diagram (abundance as a function of m/z ratio) also included in FIG. 3.

Figure 4:
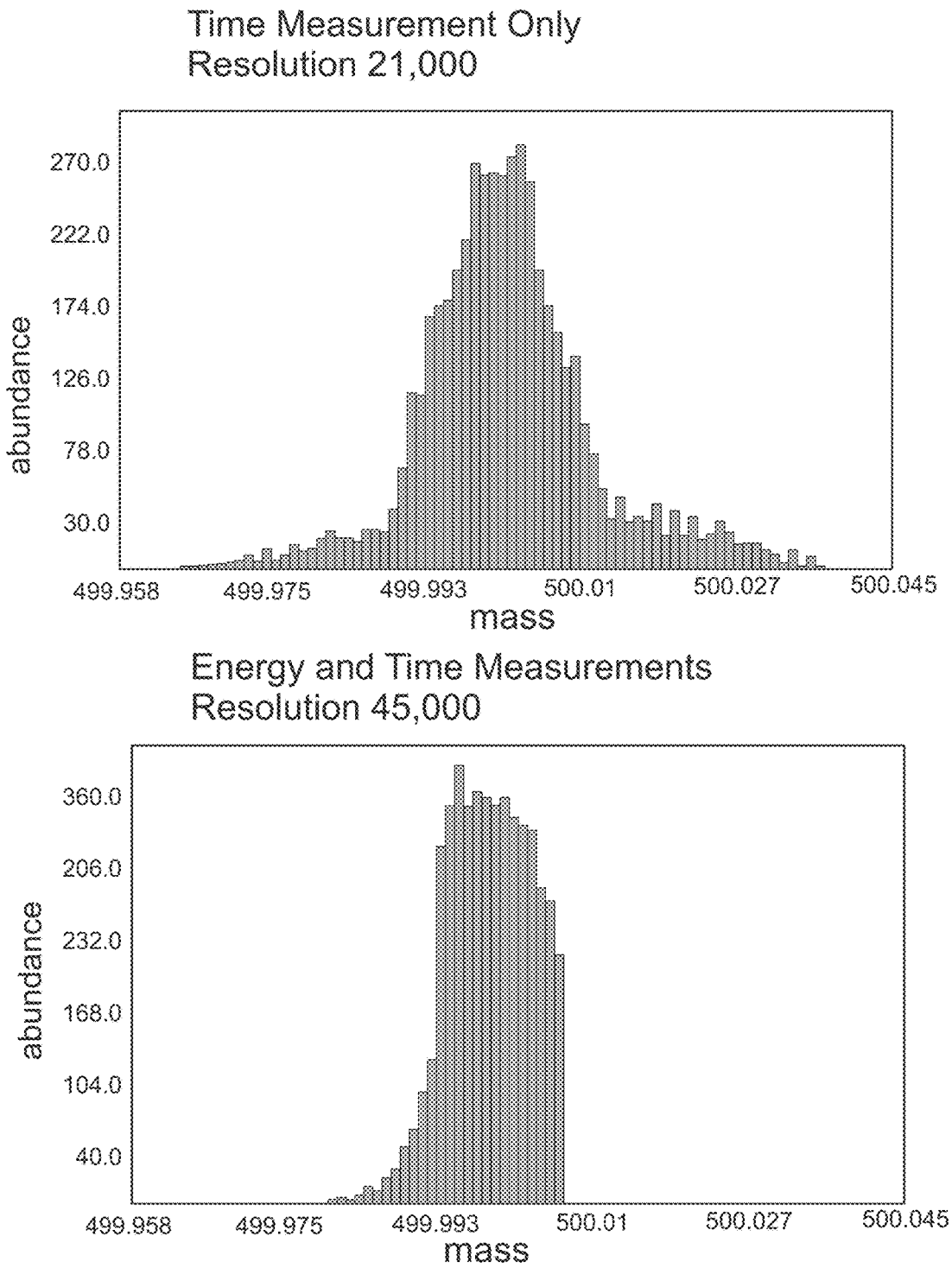
FIG. 4 shows two histograms of ion time-of-flight from simulations of ions in a TOF MS, the upper panel showing a peak where only time-of-flight was measured, and the lower panel showing a peak obtained from measuring both time-of-flight and ion energy and applying the appropriate calibration function according to some embodiments.

FIG. 4 also illustrates the advantage of ER-TOF. FIG. 4 shows two histograms of ion time-of-flight from simulations of ions in a TOF MS. The upper panel shows a peak where only time-of-flight was measured. The lower panel shows a peak obtained from measuring both time-of-flight and ion energy and applying the appropriate calibration function, which more than doubled resolution (45,000 versus 21,000).

Generally, ER-TOF may be implemented in any TOF instrument compatible with the use of an energy-sensitive ion detector, or a position-sensitive ion detector (e.g., a multi-channel ion detector) in conjunction with an energy-sensitive ion dispersion device. Some examples of such embodiments are described below.

ER-TOF may also be applied to reduce indirectly the effect of turnaround time. For example, increasing the electric field in the ion accelerator decreases the turn-around time but increases the energy spread and hence increases chromatic aberration. With the reduced chromatic aberration made possible with ER-TOF, an increased acceleration field yields a greater benefit. Similarly, beam expansion prior to the ion accelerator will increase the kinetic energy spread and reduce the angular spread, because the beam emittance is constant. The ability to correct for chromatic aberration with ER-TOF may be utilized to realize higher resolution, as shown above, or for higher sensitivity in systems with beam-limiting apertures.

Measuring ion energy and time-of-flight opens the possibility of other TOF geometries that are not currently practical. For example, a linear TOF with no mirror has low resolution because the initial space focus position is close to the original ion accelerator. Measuring ion energy may remove the need for energy compensation with the mirror. As a result, ER-TOF may form a basis for a mass spectrometer with a linear TOF which is simpler and potentially less expensive than existing TOFs.

Grid-less mirrors are sometimes used in TOFs to avoid the ion loss due to interaction with the grid wires. However, grid-less mirrors have a large aberration associated with the ion position and energy spread. ER-TOF may be applied to compensate for this aberration, particularly when using detectors which are sensitive to both energy and position. In this case, the mass calibration function depends on TOF, energy, and position.

Methods for measuring ion energy according to embodiments disclosed herein may fall into two general categories: 1) spatially dispersive methods where the ions are spread out in position with deflectors, sectors, lenses, or mirrors such that ion energy is correlated with ion location on a position-sensitive detector; and 2) energy-sensitive detectors whose single-ion response encodes the ion energy in one or more aspects.

There are several methods of spatially dispersing ions based on energy. Devices configured for spatially dispersing ions based on energy are generally referred to herein as energy-sensitive ion dispersion devices. Examples of energy-sensitive ion dispersion devices include, but are not limited to, electrostatic deflectors or sector instruments (sectors). Such devices may be simple uniform-field deflectors or more complex traditional energy-analysis sectors. As further examples, an ion deflector may be a lens configured for causing deflection of an ion whereby the angle of deflection depends on the kinetic energy of the ion. Alternatively, an ion deflector may be configured as an electrostatic ion mirror, which may be similar to the type utilized in reflectron TOF instruments. Generally, an ion dispersion device receives an ion input beam along a single input path, and outputs a plurality of energy-resolved ion output beams along a corresponding number of output paths. That is, the degree of deflection and hence ultimately the output path taken by a given ion will depend on its kinetic energy upon entering the ion dispersion device.

In various embodiments, an ion dispersion device may be positioned upstream of the ion accelerator, at (integrated with) the ion accelerator, or downstream of the ion accelerator (i.e., in the TOF flight region in the path between the ion accelerator and the ion detector). An ion dispersion device when positioned upstream of the ion accelerator may be operated to impose a correlation between the initial ion position along the acceleration direction and the ion's transverse position along the impact side of the ion detector. Generally, an ion dispersion device may be positioned at any point along the ion optical axis upstream of the ion accelerator, so long as any intervening optics between the ion dispersion device and the ion accelerator are able to preserve the energy-based dispersion created by the upstream ion dispersion device. Operation of the ion dispersion device may result in parallel output beams, which may enter the ion accelerator simultaneously. The ion accelerator may be a single unit wide enough to accept all of these parallel ion beams at the same time, or may comprise a plurality of individually controllable ion accelerators positioned in parallel with each other, each ion accelerator being sized to receive one or more of the parallel ion beams at the same time. In either case, the ion accelerator accelerates ions from each of the parallel ion beams received into the flight region as ion packets. The ion packets travel through the flight region along a plurality of spatially separated flight paths that are correlated to the original energy-resolved dispersion imposed by the ion dispersion device.

When the ion dispersion device is positioned "at" the ion accelerator, existing electrodes of the ion accelerator are operated or modified, or additional electrodes are added, such that ions entering the ion accelerator in a single primary ion beam are accelerated into the flight region in ion packets in a plurality of energy-resolved flight paths. For example, the acceleration field imparted by the ion accelerator may be applied so as to disperse ions in the transverse (x) direction in a manner that encodes kinetic energy.

When the ion dispersion device is positioned in the flight region, the ion accelerator accelerates ion packets into the flight region along a single initial flight path. The ion packets then enter the ion dispersion device, which outputs a plurality of energy-resolved output beams. If needed, the ion detector may be tilted to compensate for the beam front rotation caused by the ion dispersion device.

In all such embodiments, the ions in the different flight paths arrive at the position-sensitive ion detector, whereby the position of ion impact may be correlated with the ion's energy. For example, respective channels of a multi-channel ion detector may be optically aligned with respective flight paths. In any of the foregoing embodiments, the ion dispersion device may include two or more ion dispersion devices to realize two or more stages of energy-dependent ion dispersion.

Figure 5:
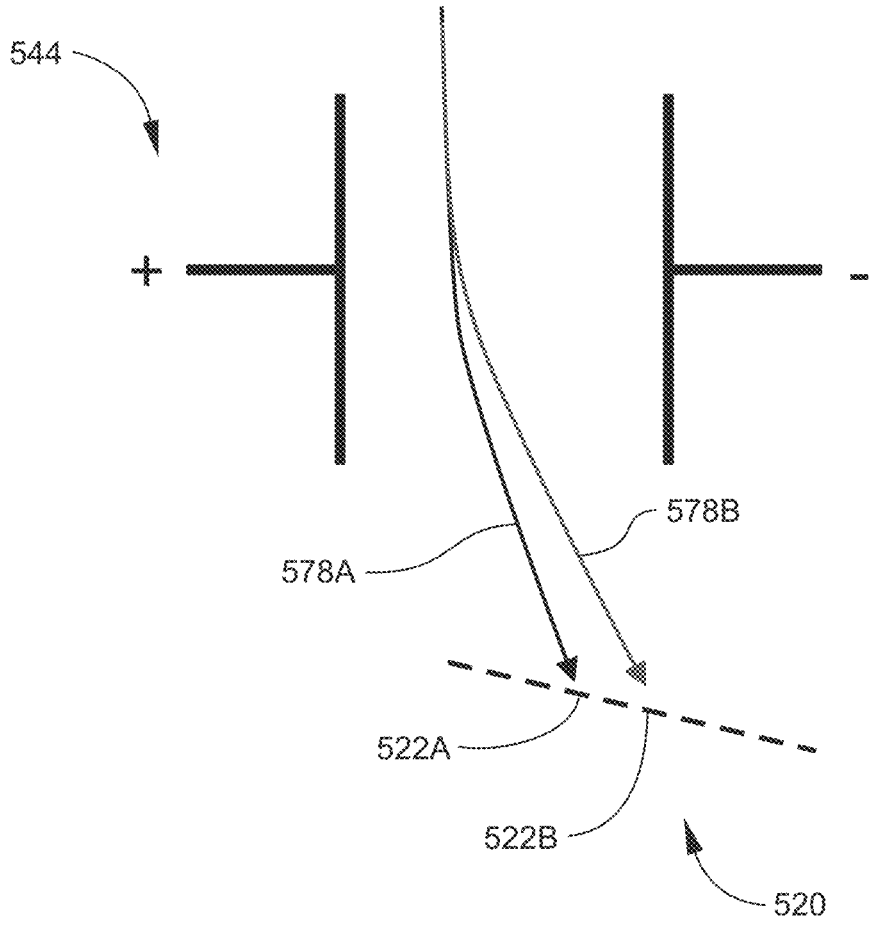
FIG. 5 is a schematic view of an example of an ion dispersion device and a position-sensitive ion detector according to some embodiments.

FIG. 5 is a schematic view of an example of an ion dispersion device 544 and a position-sensitive ion detector 520 according to some embodiments. In this example, the ion dispersion device 544 includes two parallel electrodes. However, the ion dispersion device 544 generally may be realized by various configurations entailing the use of various types of electrodes (e.g., plate electrodes, grid electrodes, etc.), as appreciated by persons skilled in the art. Generally, DC potentials are applied to the electrodes of the ion dispersion device 544 at magnitudes and polarities effective for producing a plurality of different energy-resolved ion beams (traveling in respective flight paths) spatially separated along the drift (z) axis or the transverse (x) axis. In the illustrated example, two ion beams 578A and 578B are shown for simplicity, with the understanding that more than two energy-resolved ion beams may be produced, depending on the kinetic energy distribution of the ions entering the ion dispersion device 544 and the resolution of the ion dispersion device 544. The schematic illustration of FIG. 5 implies that the ion dispersion device 544 is positioned in the TOF flight region between the ion accelerator and the ion detector 520. However, the ion dispersion device 544 may be positioned at or upstream of the ion accelerator as described above. Also in the illustrated example, the ion detector 520 includes a linear or two-dimensional array of discrete channels, two of which (channels 522A and 522B) are shown in alignment with the respective ion beams 578A and 578B.

Figure 6B:
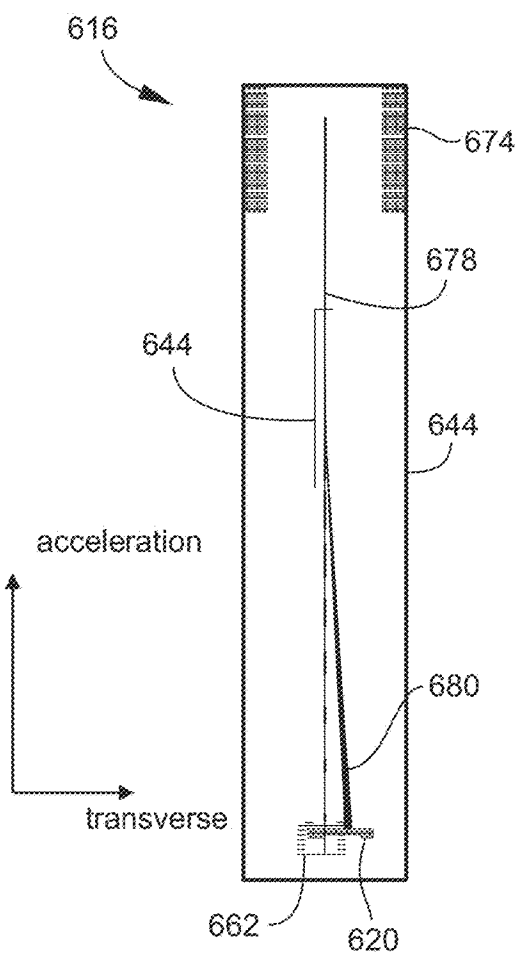
FIG. 6B is a schematic view of the TOF analyzer illustrated in FIG. 6A in the acceleration-transverse (y-x) plane.
Figure 6A:
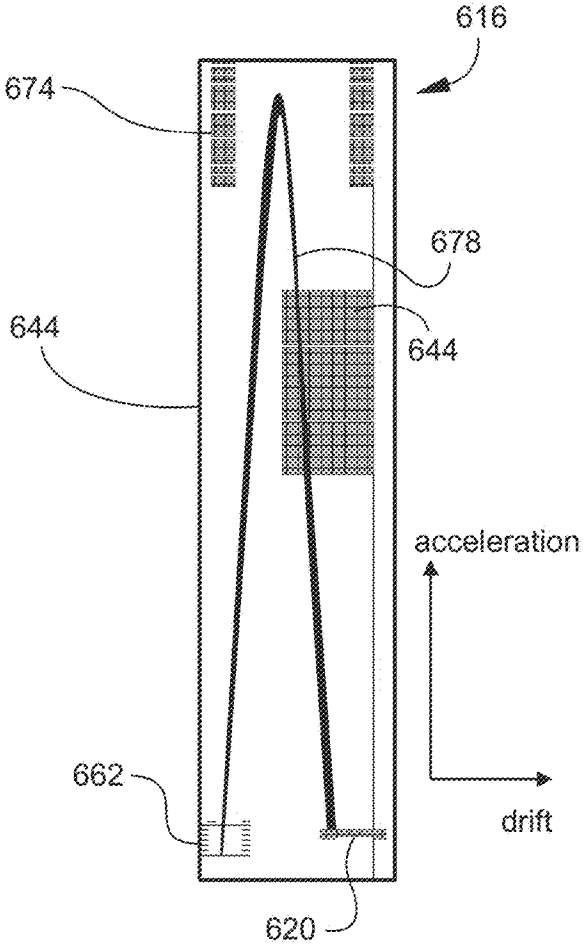
FIG. 6A is a schematic view in the acceleration-drift (y-z) plane of an example of a TOF analyzer according to some embodiments.

FIG. 6A is a schematic view in the acceleration-drift (y-z) plane of an example of a TOF analyzer 616 according to some embodiments. FIG. 6B is a schematic view of the TOF analyzer 616 in the acceleration-transverse (y-x) plane. The TOF analyzer 616 includes an ion accelerator 662 configured for orthogonal acceleration, a flight region 664, an ion mirror 674, and an ion detector 620, all as described above. As shown and described above, the TOF analyzer 616 establishes an ion flight path 678 characterized by sharp deflection imposed by the ion mirror 674. Due to the ions having a non-zero kinetic energy component in the drift direction, there is an angle of divergence between the portion of the ion flight path 678 incoming into the ion mirror 674 and the portion of the ion flight path 678 outgoing from the ion mirror 674, such that the ion detector 620 is spaced from the ion accelerator 662 along the drift axis. The TOF analyzer 616 further includes an ion dispersion device 644 positioned in the flight region 664. In the illustrated embodiment, the ion dispersion device 644 is positioned in the flight path between the ion mirror 674 and the ion detector 620. Also in this embodiment, the ion dispersion device 644 is configured for deflecting ions on an energy-dependent basis in the acceleration-transverse (y-x) plane, as represented by deflected ion beam(s) 680 in FIG. 6B.

Figure 7B:
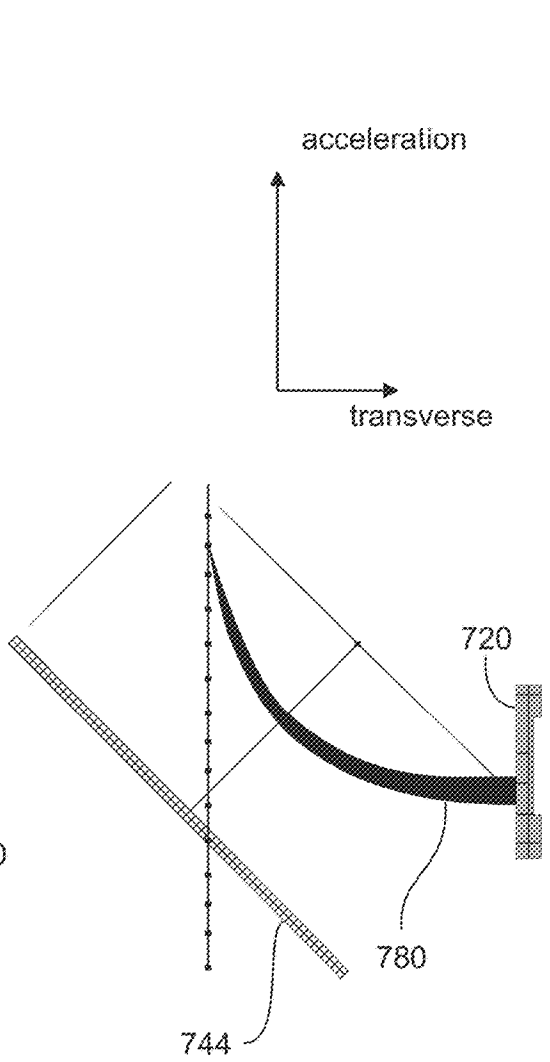
FIG. 7B is a schematic view of the TOF analyzer illustrated in FIG. 7A in the acceleration-transverse (y-x) plane.

As noted above, electrostatic mirrors may also be utilized to disperse ions according to energy. For example, the mirror in a conventional oa-TOF introduces a spatial dispersion along the drift-direction due to kinetic energy associated with the acceleration-direction, as shown in FIG. 6A. However, for typical geometries the dispersion distance is much less than other contributions to beam size. To increase the dispersion, one or more additional mirrors may be added to the flight path such as shown in FIGS. 7A and 7B.

Figure 7A:
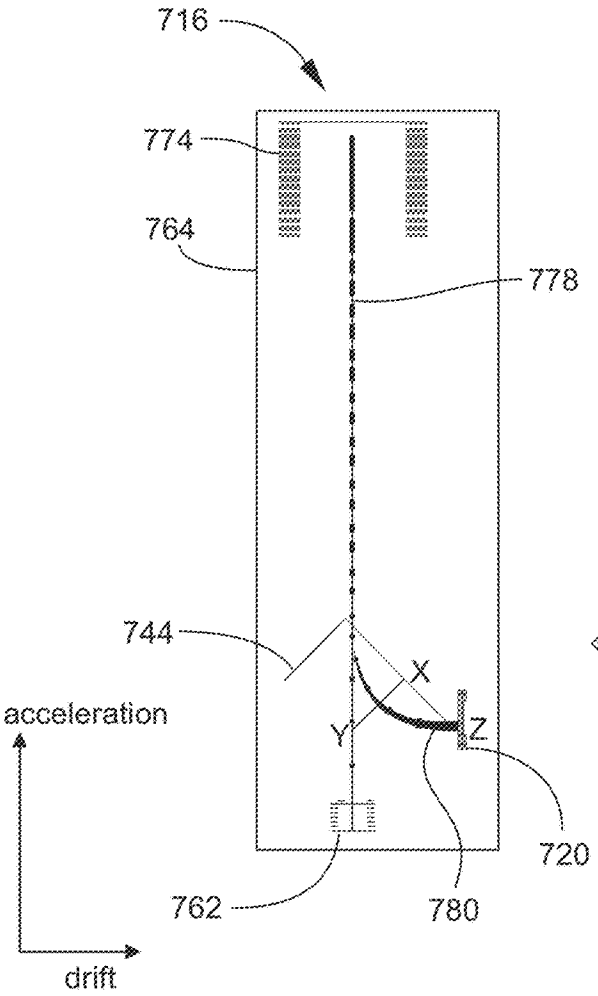
FIG. 7A is a schematic view in the acceleration-drift (y-z) plane of an example of a TOF analyzer according to other embodiments.
Figure 7A:
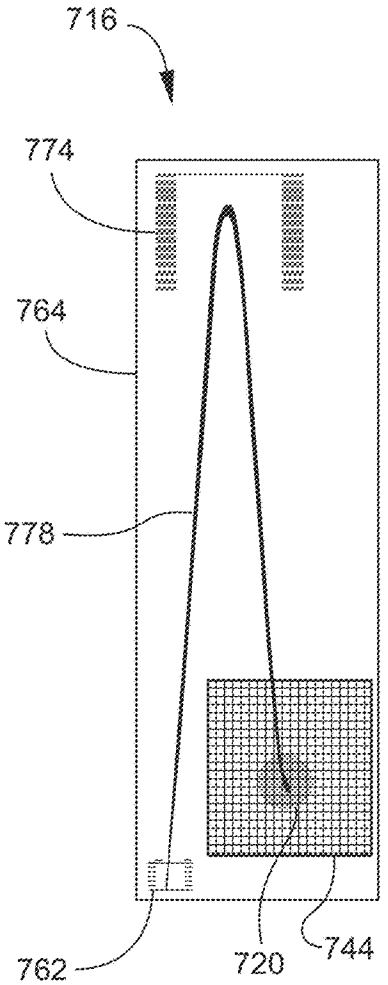

Specifically, FIG. 7A is a schematic view in the acceleration-drift (y-z) plane of an example of a TOF analyzer 716 according to other embodiments. FIG. 7B is a schematic view of the TOF analyzer 716 in the acceleration-transverse (y-x) plane. The TOF analyzer 716 includes an ion accelerator 762 configured for orthogonal acceleration, a flight region 764, an ion mirror 774, and an ion detector 720, all as described above. As shown and described above, the TOF analyzer 716 establishes an ion flight path 778 that is deflected by the ion mirror 774. In the present embodiment, in addition to the (first) ion mirror 774, the TOF analyzer 716 further includes a second ion mirror 744 that serves as an energy-sensitive ion dispersion device. As shown, the second ion mirror 744 is positioned in the flight region 764 between the first ion mirror 774 and the ion detector 720. The second ion mirror 744 is configured for deflecting ions on an energy-dependent basis in the acceleration-transverse (y-x) plane, as represented by deflected ion beam(s) 780 in FIG. 7B and the inset thereof. In this arrangement, it is advantageous to reflect the ions by a large angle such as 90° to increase dispersion.

Figure 8B:
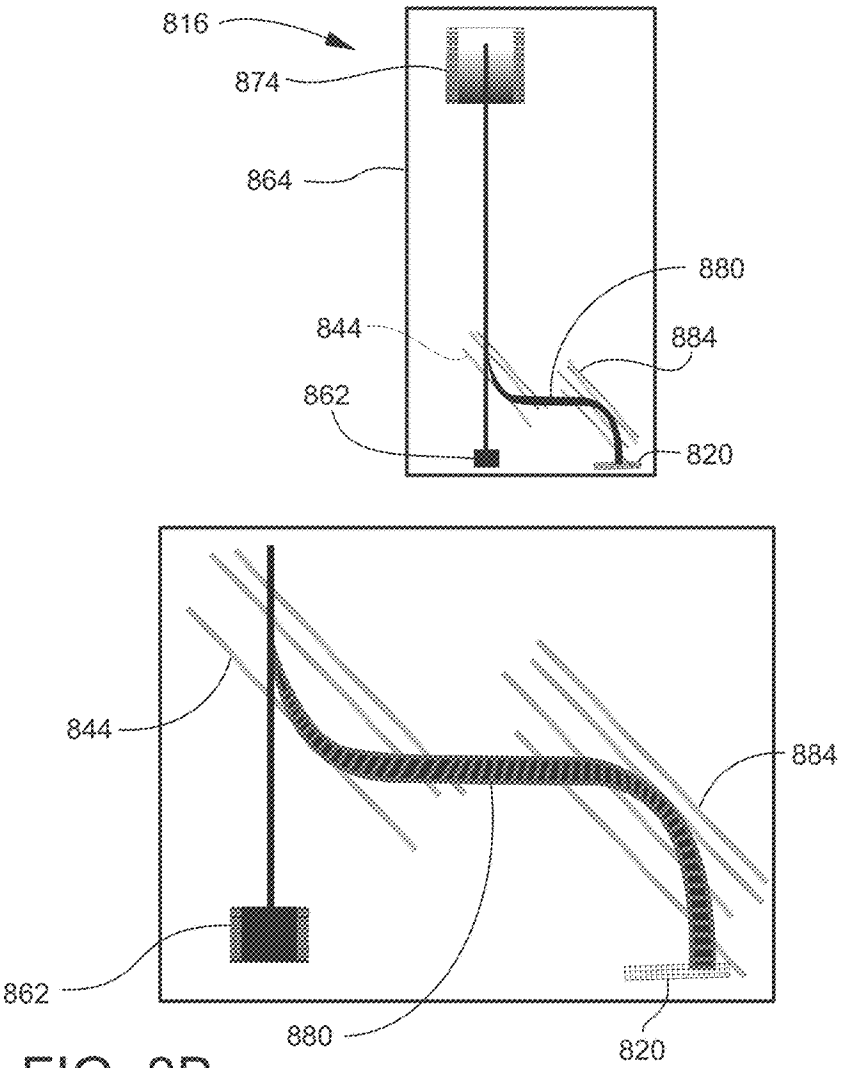
FIG. 8B is a schematic view of the TOF analyzer illustrated in FIG. 8A in the acceleration-transverse (y-x) plane.
Figure 8A:
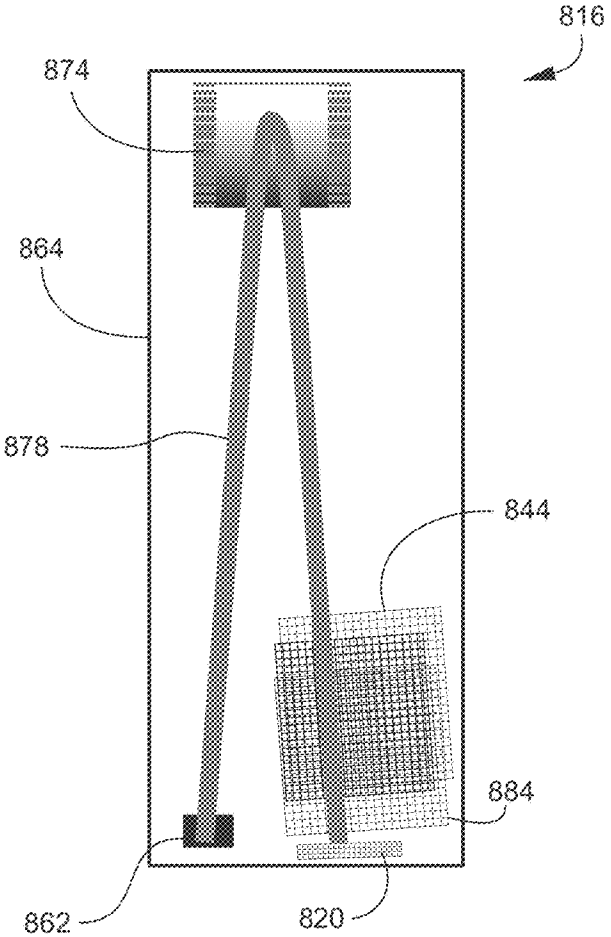
FIG. 8A is a schematic view in the acceleration-drift (y-z) plane of an example of a TOF analyzer according to other embodiments.

FIG. 8A is a schematic view in the acceleration-drift (y-z) plane of an example of a TOF analyzer 816 according to other embodiments. FIG. 8B is a schematic view of the TOF analyzer 816 in the acceleration-transverse (y-x) plane. The TOF analyzer 816 includes an ion accelerator 862 configured for orthogonal acceleration, a flight region 864, an ion mirror 874, and an ion detector 820, all as described above. As shown and described above, the TOF analyzer 816 establishes an ion flight path 878 that is deflected by the ion mirror 874. In the present embodiment, in addition to the (first) ion mirror 874, the TOF analyzer 816 further includes a second ion mirror 844 and a third ion mirror 884 that collectively serve as a multi-stage energy-sensitive ion dispersion device. As shown, the second ion mirror 844 and third ion mirror 884 are positioned in the flight region 864 between the first ion mirror 874 and the ion detector 820, and are configured for deflecting ions on an energy-dependent basis in the acceleration-transverse (y-x) plane, as represented by deflected ion beam(s) 880 in FIG. 7B and the inset thereof. Further, the second ion mirror 844 and third ion mirror 884 are oriented such deflection occurs in two different directions. In the example specifically illustrated, the second ion mirror 844 causes a deflection of about 90° from the acceleration axis to the transverse axis, and the third ion mirror 884 causes a subsequent deflection of about 90° from the transverse axis back to the acceleration axis. In other embodiments, one or more additional ion mirrors or other type of ion dispersion devices may be included to realize additional stages of energy-dependent ion dispersion.

In further embodiments, energy-sensitive ion detectors may be utilized alternatively or in addition to ion dispersion devices. Energy-sensitive detectors may be realized by exploiting the fact the intrinsic detector response is often dependent on ion energy. As examples, in ion detectors utilizing electron multipliers, the number of the secondary electrons emitted per ion is dependent on the ion energy. In ion detectors utilizing photomultipliers, scintillator light output is generally linearly related to the energy of the incident particle. The number of electron-hole pairs created in a semiconductor diode detector is linearly related to particle energy, a feature commonly exploited in many forms of x-ray and gamma ray spectroscopy and high energy physics. In any of these cases, the ion energy can in principle be extracted from the single-ion peak height, peak area, or other peak shape characteristics. For example, techniques such as time-over-threshold determination or the use of multiple thresholds are methods of extracting pulse height when using time-to-digital converters. The use of high-channel count pixelated time-to-digital converters may be particularly advantageous for both energy-sensitive detection and the energy-dispersive methods. Other examples of energy-sensitive detectors include bolometers, micro-calorimeters, and superconducting transition detectors.

The energy resolution of all of the energy-sensitive detectors discussed above depends on the number of secondary excitations created by a single ion and the Fano factor. Energy-resolved TOF does not require a large number of resolvable energy channels—based on simulations, as few as five channels is likely to result in an improvement. To increase the energy resolution, it may be advantageous to use high ion impact energy, for example through post-acceleration. The number of secondary excitations is likely to depend on ion mass and may be accounted for by the calibration function.

In addition to pulse height, area, or shape, more than one channel of the ion detector may be utilized to encode ion energy. For example, in a semiconductor detector with a transmissive front electrode and a back electrode for charge collection, the front and back electrodes will collect differing portions of the excited electron-hole pairs based on the depth of the excitation, which is determined by the ion energy. The relative pulse height from the front and back electrodes may be utilized to determinate particle energy.

Exemplary Embodiments

Exemplary embodiments provided in accordance with the presently disclosed subject matter include, but are not limited to, the following:

1. A time-of-flight mass spectrometry (TOF-MS) system, comprising: an ion source; a TOF analyzer comprising an ion accelerator, a flight region, and an ion detector comprising a plurality of channels; and an ion dispersion device configured for dispersing ions from the ion source into a plurality of spatially separated ion beams based on different kinetic energies of the ions, wherein ions of different kinetic energies travel in the flight region in spatially separated flight paths and respective channels are aligned with the flight paths.

2. The TOF-MS system of embodiment 1, wherein the ion dispersion device is positioned upstream of the ion accelerator, at the ion accelerator, or in the flight region.

3. The TOF-MS system of embodiment 1, wherein the ion dispersion device is positioned upstream of the ion accelerator, and the ion accelerator is configured for receiving the spatially separated ion beams simultaneously and accelerating ions from the spatially separated ion beams into the flight region along the spatially separated flight paths.

4. The TOF-MS system of embodiment 1 or 3, wherein the ion dispersion device is positioned upstream of the ion accelerator, and the ion accelerator comprises a plurality of ion accelerators, each ion accelerator configured for receiving one or more of the ion beams.

5. The TOF-MS system of embodiment 1, wherein the ion dispersion device is positioned at the ion accelerator, and the ion accelerator is configured for receiving a primary ion beam and accelerating ions dispersed by the ion dispersion device into the flight region along the spatially separated flight paths.

6. The TOF-MS system of embodiment 1, wherein the ion dispersion device is positioned in the flight region, and is configured for receiving ions traveling in an initial flight path from the ion accelerator and dispersing the ions into the spatially separated flight paths.

7. The TOF-MS system of any of the preceding embodiments, wherein the ion dispersion device comprises an ion deflector, an ion mirror, an electrostatic sector instrument, an energy-analysis sector instrument, or a combination or two or more of the foregoing.

8. The TOF-MS system of any of the preceding embodiments 1, wherein the ion dispersion device comprises a plurality of ion dispersion devices arranged such that each ion dispersion device receives the ions outputted from a preceding ion dispersion device or outputs ions to a succeeding ion dispersion device.

9. The TOF-MS system of any of the preceding embodiments 1, comprising a computing device configured for: receiving an ion measurement signal from the ion detector corresponding to detection of an ion; determining a time of flight and a kinetic energy of the ion based on the ion measurement signal; and calculating a mass of the ion by applying a mass calibration function based on the time of flight and the kinetic energy.

10. A time-of-flight mass spectrometry (TOF-MS) system, comprising: an ion source; and a TOF analyzer comprising an ion accelerator, a flight region, and an energy-sensitive ion detector, wherein the energy-sensitive ion detector is configured for both detecting arrival times of ions and measuring kinetic energy of the ions.

11. The TOF-MS system of embodiment 10, wherein the energy-sensitive ion detector is configured for measuring secondary excitations created in response to arrival of an ion at the energy-sensitive ion detector.

12. The TOF-MS system of embodiment 10 or 11, comprising a computing device configured for: receiving an ion measurement signal from the ion detector corresponding to detection of an ion; determining a time of flight and a kinetic energy of the ion based on the ion measurement signal; and calculating a mass of the ion by applying a mass calibration function based on the time of flight and the kinetic energy.

13. A method for performing time-of-flight mass spectrometry (TOF-MS), the method comprising: receiving an ion measurement signal from an ion detector of a TOF analyzer corresponding to detection of an ion; determining a time of flight and a kinetic energy of the ion based on the ion measurement signal; and calculating a mass of the ion by applying a mass calibration function based on the time of flight and the kinetic energy.

14. The method of embodiment 13, comprising: dispersing ions into a plurality of spatially separated ion beams based on different kinetic energies of the ions; and transmitting the ions to the ion detector, wherein ions of different kinetic energies arrive at different positions on the ion detector; and correlating the positions with respective kinetic energies.

15. The method of embodiment 14, comprising transmitting the ions into an ion accelerator of the TOF analyzer and operating the ion accelerator to accelerate the ions into a flight region of the TOF analyzer, wherein dispersing the ions is performed before transmitting the ions into the ion accelerator, or at the ion accelerator, or in the flight region after accelerating the ions.

16. The method of embodiment 14 or 15, wherein dispersing the ions comprises operating an ion dispersion device comprising an ion deflector, an ion mirror, an electrostatic sector instrument, an energy-analysis sector instrument, or a combination or two or more of the foregoing.

17. The method of any of embodiments 14 to 16, wherein dispersing the ions comprises operating a plurality of ion dispersion devices arranged such that each ion dispersion device receives the ions outputted from a preceding ion dispersion device or outputs ions to a succeeding ion dispersion device.

18. The method of any of embodiments 13 to 17, wherein the ion detector is an energy-sensitive ion detector configured for both detecting arrival times of ions and measuring kinetic energy of the ions.

19. The method of embodiment 18, wherein the energy-sensitive ion detector is configured for measuring secondary excitations created in response to arrival of an ion at the energy-sensitive ion detector.

20. A time-of-flight mass spectrometry (TOF-MS) system configured for performing all or part of the method of any of the preceding embodiments.

21. A time-of-flight mass spectrometry (TOF-MS) system comprising: a TOF analyzer; an ion detector; and a computing device configured for performing all or part of the method of any of the preceding embodiments.

22. The TOF-MS system of embodiment 21, comprising an ion source.

23. A system for acquiring spectral data from a sample, the system comprising: a processor and a memory configured for performing all or part of the method of any of the preceding embodiments.

24. The system of embodiment 23, comprising a computing device and an ion detector, wherein the computing device comprises the processor and the memory, and the ion detector is configured for transmitting ion measurement signals to the computing device.

25. A computer-readable storage medium comprising instructions for performing all or part of the method of any of the preceding embodiments.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the computing device 140 schematically depicted in FIG. 1. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the computing device 140 in FIG. 1), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A time-of-flight mass spectrometry (TOF-MS) system, comprising:

an ion source;

a TOF analyzer comprising an ion accelerator, a flight region, and an ion detector comprising a plurality of channels;

an ion dispersion device configured for dispersing ions from the ion source into a plurality of spatially separated ion beams based on different kinetic energies of the ions, wherein ions of different kinetic energies travel in the flight region in spatially separated flight paths and respective channels are aligned with the flight paths; and a computing device configured for:

receiving an ion measurement signal from the ion detector corresponding to detection of an ion;

determining a time of flight and a kinetic energy of the ion based on the ion measurement signal; and calculating a mass of the ion by applying a mass calibration function based on the time of flight, the kinetic energy, and one or more instrument-dependent calibration constants.

2. The TOF-MS system of claim 1, wherein the ion dispersion device is positioned upstream of the ion accelerator, at the ion accelerator, or in the flight region.

3. The TOF-MS system of claim 1, wherein the ion dispersion device is positioned upstream of the ion accelerator, and the ion accelerator is configured for receiving the spatially separated ion beams simultaneously and accelerating ions from the spatially separated ion beams into the flight region along the spatially separated flight paths.

4. The TOF-MS system of claim 1, wherein the ion dispersion device is positioned upstream of the ion accelerator, and the ion accelerator comprises a plurality of ion accelerators, each ion accelerator configured for receiving one or more of the ion beams.

5. The TOF-MS system of claim 1, wherein the ion dispersion device is positioned at the ion accelerator, and the ion accelerator is configured for receiving a primary ion beam and accelerating ions dispersed by the ion dispersion device into the flight region along the spatially separated flight paths.

6. The TOF-MS system of claim 1, wherein the ion dispersion device is positioned in the flight region, and is configured for receiving ions traveling in an initial flight path from the ion accelerator and dispersing the ions into the spatially separated flight paths.

7. The TOF-MS system of claim 1, wherein the ion dispersion device comprises an ion deflector, an ion mirror, an electrostatic sector instrument, an energy-analysis sector instrument, or a combination or two or more of the foregoing.

8. The TOF-MS system of claim 1, wherein the ion dispersion device comprises a plurality of ion dispersion devices arranged such that each ion dispersion device receives the ions outputted from a preceding ion dispersion device or outputs ions to a succeeding ion dispersion device.

9. A time-of-flight mass spectrometry (TOF-MS) system, comprising:

an ion source;

a TOF analyzer comprising an ion accelerator, a flight region, and an energy-sensitive ion detector, wherein the energy-sensitive ion detector is configured for both detecting arrival times of ions and measuring kinetic energy of the ions; and receiving an ion measurement signal from the ion detector corresponding to detection of an ion;

determining a time of flight and a kinetic energy of the ion based on the ion measurement signal; and calculating a mass of the ion by applying a mass calibration function based on the time of flight and the kinetic energy.

10. The TOF-MS system of claim 9, wherein the energy-sensitive ion detector is configured for measuring secondary excitations created in response to arrival of an ion at the energy-sensitive ion detector.

11. A method for performing time-of-flight mass spectrometry (TOF-MS), the method comprising:

receiving an ion measurement signal from an ion detector of a TOF analyzer corresponding to detection of an ion;

determining a time of flight and a kinetic energy of the ion based on the ion measurement signal; and calculating a mass of the ion by applying a mass calibration function based on the time of flight, the kinetic energy, and one or more instrument-dependent calibration constants.

12. The method of claim 11, comprising:

before receiving the ion measurement signal, dispersing ions into a plurality of spatially separated ion beams based on different kinetic energies of the ions; and transmitting the ions to the ion detector, wherein ions of different kinetic energies arrive at different positions on the ion detector, and further comprising correlating the positions with respective kinetic energies.

13. The method of claim 12, comprising transmitting the ions into an ion accelerator of the TOF analyzer and operating the ion accelerator to accelerate the ions into a flight region of the TOF analyzer, wherein dispersing the ions is performed before transmitting the ions into the ion accelerator, or at the ion accelerator, or in the flight region after accelerating the ions.

14. The method of claim 12, wherein dispersing the ions comprises operating an ion dispersion device comprising an ion deflector, an ion mirror, an electrostatic sector instrument, an energy-analysis sector instrument, or a combination or two or more of the foregoing.

15. The method of claim 12, wherein dispersing the ions comprises operating a plurality of ion dispersion devices arranged such that each ion dispersion device receives the ions outputted from a preceding ion dispersion device or outputs ions to a succeeding ion dispersion device.

16. The method of claim 11, wherein the ion detector is an energy-sensitive ion detector configured for both detecting arrival times of ions and measuring kinetic energy of the ions.

17. The method of claim 16, wherein the energy-sensitive ion detector is configured for measuring secondary excitations created in response to arrival of an ion at the energy-sensitive ion detector.

18. A system for acquiring spectral data from a sample, the system comprising: a processor and a memory configured for performing the method of claim 11.

19. A time-of-flight mass spectrometry (TOF-MS) system, comprising:

an ion source;

a TOF analyzer comprising an ion accelerator, a flight region, and an ion detector comprising a plurality of channels; and an ion dispersion device configured for dispersing ions from the ion source into a plurality of spatially separated ion beams based on different kinetic energies of the ions, wherein ions of different kinetic energies travel in the flight region in spatially separated flight paths and respective channels are aligned with the flight paths, and wherein the ion dispersion device has a configuration selected from the group consisting of:

the ion dispersion device is positioned upstream of the ion accelerator, and the ion accelerator is configured for receiving the spatially separated ion beams simultaneously and accelerating ions from the spatially separated ion beams into the flight region along the spatially separated flight paths;

the ion dispersion device is positioned upstream of the ion accelerator, and the ion accelerator comprises a plurality of ion accelerators, each ion accelerator configured for receiving one or more of the ion beams;

the ion dispersion device is positioned at the ion accelerator, and the ion accelerator is configured for receiving a primary ion beam and accelerating ions dispersed by the ion dispersion device into the flight region along the spatially separated flight paths; and the ion dispersion device comprises a plurality of ion dispersion devices arranged such that each ion dispersion device receives the ions outputted from a preceding ion dispersion device or outputs ions to a succeeding ion dispersion device.

20. The TOF-MS system of claim 19, wherein the ion dispersion device comprises an ion deflector, an ion mirror, an electrostatic sector instrument, an energy-analysis sector instrument, or a combination or two or more of the foregoing.

21. The TOF-MS system of claim 19, comprising a computing device configured for:

receiving an ion measurement signal from the ion detector corresponding to detection of an ion;

determining a time of flight and a kinetic energy of the ion based on the ion measurement signal; and calculating a mass of the ion by applying a mass calibration function based on the time of flight and the kinetic energy.

* * * * *